United States Patent [19]

Cook

[11] Patent Number: 4,601,831

[45] Date of Patent: Jul. 22, 1986

[54] ANTIMICROBIAL ADJUSTMENT TECHNIQUE

[75] Inventor: Michael M. Cook, Boxford, Mass.

[73] Assignee: Morton Thiokol, Inc., Chicago, Ill.

[21] Appl. No.: 657,116

[22] Filed: Oct. 3, 1984

[51] Int. Cl.[4] ..... B01D 15/00

[52] U.S. Cl. ..... 210/692; 68/18 R; 210/764; 210/167; 210/501; 428/395

[58] Field of Search ..... 210/688, 692, 764, 167, 210/195.1, 196, 257.1, 284, 314, 317, 340, 341, 343, 501; 424/16, 27, 135; 428/395; 68/18 R, 18 F

[56] References Cited

U.S. PATENT DOCUMENTS

| | | | |
|---|---|---|---|
| 1,575,907 | 3/1926 | Genter | 210/343 |
| 2,302,552 | 11/1942 | Johnson | 210/317 |
| 3,085,416 | 4/1963 | D'Hooge | 68/18 F |
| 3,161,622 | 12/1964 | Harrington et al. | 424/27 |
| 3,327,859 | 6/1967 | Pall | 210/266 |
| 3,345,341 | 10/1967 | Berry et al. | 424/27 |
| 3,597,351 | 8/1971 | Landenburg et al. | 210/673 |
| 3,701,625 | 10/1972 | Sieber | 8/158 |
| 3,715,339 | 2/1973 | Rainer | 210/688 |
| 3,829,380 | 8/1974 | Oohara | 210/909 |
| 3,959,556 | 5/1976 | Morrison | 428/365 |
| 3,979,292 | 9/1976 | Kuhn | 210/120 |
| 4,079,001 | 3/1978 | Haase et al. | 210/502 |
| 4,238,328 | 12/1980 | Bowes et al. | 210/688 |
| 4,256,588 | 3/1981 | Hoehn et al. | 210/692 |
| 4,478,714 | 10/1984 | Blake et al. | 210/340 |
| 4,483,771 | 11/1984 | Koch | 210/501 |

FOREIGN PATENT DOCUMENTS

| | | | |
|---|---|---|---|
| 2355893 | 5/1974 | Fed. Rep. of Germany | 210/501 |
| 49-41270 | 11/1974 | Japan | 210/688 |
| 0686992 | 9/1979 | U.S.S.R. | 210/764 |

*Primary Examiner*—Peter Hruskoci

*Attorney, Agent, or Firm*—Gerald K. White

[57] ABSTRACT

A system containing beds of polymeric material containing antimicrobial agents are used to adjust the antimicrobial agent concentration of treatment streams used for treating fibers with antimicrobial agents. The adjustment step is performed by passing the stream through a bed which contains the agent in a concentration different than that of the stream.

9 Claims, 3 Drawing Figures

ANTIMICROBIAL ADJUSTMENT TECHNIQUE

CROSS REFERENCE TO OTHER APPLICATIONS

This application is related in subject matter to four other applications that were filed concurrently with this application and were commonly assigned. They are: application Ser. No. 657,119, invented by Lawrence J. Guilbault, Thomas C. McEntee, and Judith L. Koob and entitled "METHOD FOR CONTROLLING ANTIMICROBIAL CONTENT OF FIBERS"; application Ser. No. 657,118, invented by Lawrence J. Guilbault and Thomas C. McEntee and entitled "METHOD OF REMOVING A TOXICANT FROM WASTEWATER"; application Ser. No. 657,117, invented by Thomas C. McEntee, Lawrence J. Guilbault, Judith L. Koob and James F. Brophy and entitled "METHOD FOR INCORPORATING ANTIMICROBIALS INTO FIBERS"; and application Ser. No. 657,278, invented by Thomas C. McEntee, Lawrence J. Guilbault, Judith L. Koob and James F. Brophy and entitled "METHOD FOR INCORPORATING ANTIMICROBIALS INTO FIBERS".

BACKGROUND OF THE INVENTION

This invention generally pertains to the use of polyamide beds which contain an antimicrobial agent. The beds are used to adjust the antimicrobial agent content of aqueous media. The beds are employed in combination with a system or technique which serves to perform the desired adjustment in antimicrobial agent concentration. Nylon is a typical polyamide material and 10,10'-oxybisphenoxarsine (OBPA) is a typical antimicrobial agent.

Four concurrently filed patent applications of the assignee of this invention mentioned above involve the discovery that a chemical equilibrium of antimicrobial agents exist between fibers and aqueous media containing such agent. Application Ser. No 657,119 involves a method for controlling the antimicrobial agent content of fibers during processing subsequent to the incorporation of the agent into molten material prior to the spinning step. Application Ser. Nos. 657,117 and 657,278 deal with a method for incorporating antimicrobial agents into fibers during process steps following the spinning operations. Application Ser. No. 657,118 discloses a method of removing antimicrobial agents from aqueous media. As will be observed, this application is directed to an overall system that will enable one to advantageously practice the above discussed inventions.

SUMMARY OF THE INVENTION

The invention generally pertains to a method and system for adjusting the antimicrobial agent concentration of aqueous media. The technique comprises passing a stream which contains an antimicrobial agent through and in contact with a bed of solid polyamide material which contains a different concentration of the agent than that of the stream. Such procedure causes the antimicrobial agent to be adjusted; i.e.; either to increase or decrease, depending upon the relative concentrations.

A system for practice of the method may comprise a fiber treating vessel, reversible means for transferring antimicrobial agent containing aqueous media to and from the vessel with at least two vessels which contain beds of polyamide materials which contains an antimicrobial agent.

BRIEF DESCRIPTION OF THE DRAWING

The FIG. 1 is a schematic illustration of a system or combination of apparatus that is suitable for conducting the process of the inventions.

DETAILED DESCRIPTION OF THE INVENTION

Figure 1:
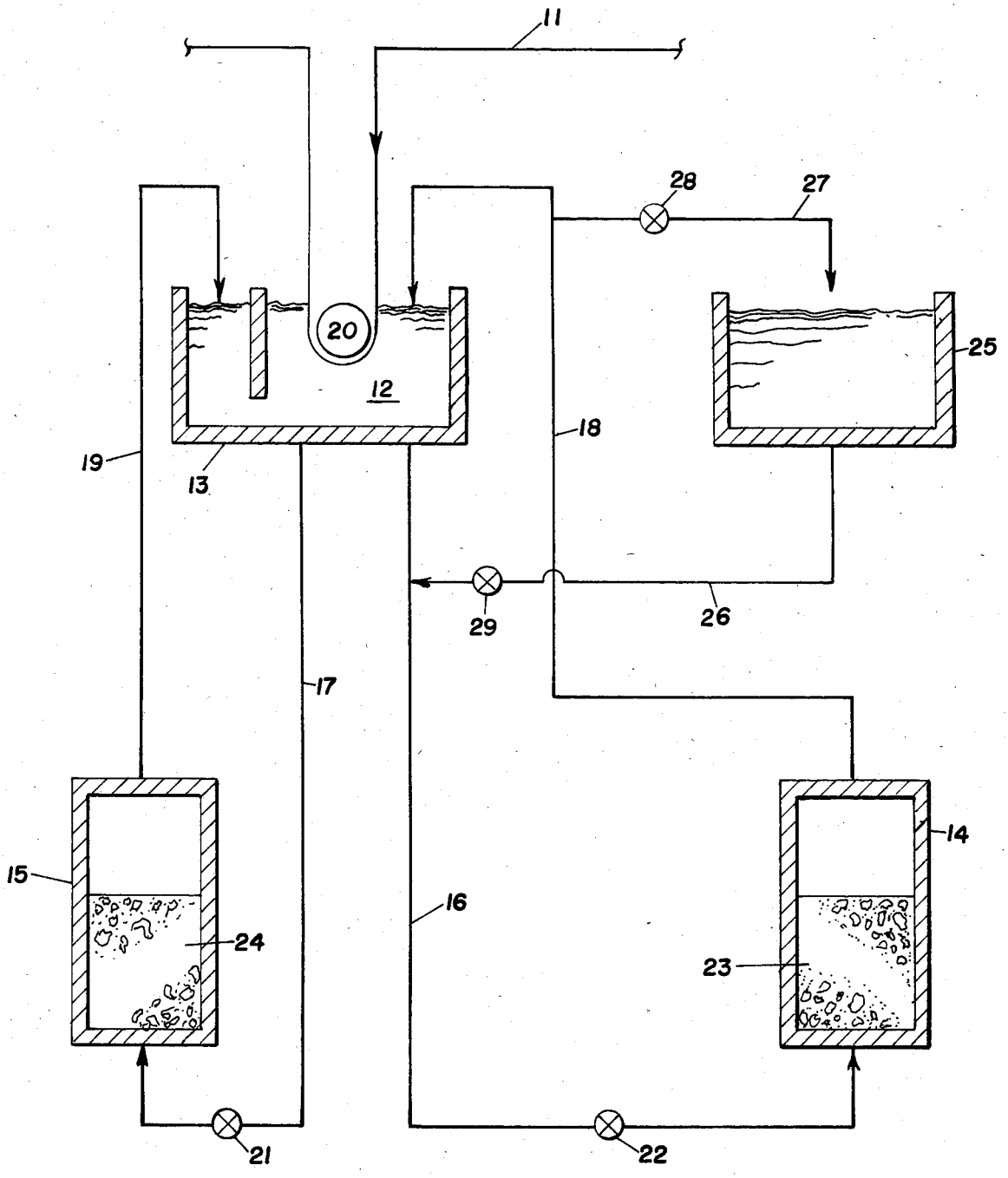

It has been discovered that the concentration of antimicrobial agents in aqueous media can be substantially adjusted by contacting aqueous media with a solid polyamide material in the form of pellets, fibers, foams, granules, film or coatings. Antimicrobial agents exhibit a high affinity toward polyamide materials, relative to the aqueous phase. Partition coefficients, i.e., the ratio of antimicrobial agent absorbed by the polyamide absorbant relative to that retained in the aqueous phase, at equilibrium, can be very high, ranging from 10:1 to 100:1 or higher. These favorable partition coefficients enable substantial removal of antimicrobial agents from aqueous media simply by contacting and thereby equilibriating the aqueous media with the polyamide material to facilitate rapid absorption of the antimicrobial agent by the polyamide material or, if desired, transfer of the antimicrobial agent from the polyamide material into the aqueous media. Adjustment of antimicrobial agent concentration may be effected in both directions depending upon the relative concentrations in the polyamide material and in the aqueous media, contact time, face velocity, and temperature in the bed.

While not desiring to be bound by the following explanation, it is believed that the beneficial effects of polyamide material in adjusting the concentration of antimicrobial agents in aqueous media is due to the following. First, the agents, being somewhat polar yet decidedly organic in nature appear to have a solubility preference for polyamide relative to water. The generally low water solubility of many antimicrobial agents tends to support this preference. Secondly, polyamides in general, and nylon in particular are well known to absorb appreciable quantities of water under equilibrium conditions, up to 10–15% by weight in some instances. Thus the preference of the agent for polyamide over water and the case by which water is absorbed into polyamide provides a driving force and transport mechanism by which agents are absorbed from aqueous media into polyamide materials.

This invention is adapted to be used in combination with the inventions described in the concurrently filed applications discussed below.

The invention described in above mentioned application Ser. Nos. 657,117 and 657,278 involves a method of incorporating an antimicrobial agent into a fiber which includes treating a fiber which does not include the agent by passing such fiber into a liquid containing a sufficient concentration of the agent to cause the agent to be exhausted into the fiber. The resultant product is characterized by having an essentially homogeneous distribution of the agent throughout the fiber cross-section. The product exhibits increased durability in this form.

The invention described in application Ser. No. 657,119 pertains to a technique for controlling the concentration of previously incorporated antimicrobial agents during processing of the fiber in aqueous media following the initial incorporation step. This technique serves to increase, decrease, or maintain essentially constant the antimicrobial agent concentration of a fiber. An important aspect of such control process is the antimicrobial agent concentration in the aqueous medium.

Fibers, articles constructed of fibers, and nonwoven fabrics are suitable for use in connection with the inventions of the above mentioned concurrently filed applications described above and include synthetic, semisynthetic, or natural fibers or blends thereof. It is expected that these methods of biocide incorporation or control would also be useful with other biocides with similar hydrophobic/solubility properties and in treating other fiber compositions such as acrylics and polyesters. Synthetic fibers include but are not limited to polyamides such as Nylon 6 and Nylon 66, polyesters, polyacrylics, and modified cellulosics.

The concept of this disclosure involves a practical method for addition and/or removal of such antimicrobial agents to or from solvents or solvent treatment baths to practice one or more the above mentioned concurrently filed methods. This involves two or more beds of nylon resin at least one of which would contain high levels of the antimicrobial agent in the resin ("AM Rich Bed") and at least another of which would contain zero or low levels of the antimicrobial agent ("AM Poor Bed").

The antimicrobial agent may be added to the solvent used in the fiber treatment bath by passing the solvent through the AM Rich Bed at suitable combinations of face velocity, contact time and temperature until sufficient concentration of antimicrobial agent is dissolved in the solvent. Continuous cycling of the solvent through the AM Rich Bed will maintain this concentration to the bath during use. Operating parameters such as solvent temperature, bed contact time and face velocity through the bed, are readily determined by those skilled in the art and would be readily utilized to design the bed size and configuration.

The antimicrobial agent may be removed from solution by passing the solution through the "AM Poor Bed" at appropriate operating conditions to transfer all or a desired level of antimicrobial agent into the resin.

It is conceivable that when the "AM Rich Bed" is depleted of antimicrobial agent, it may be utilized as the "AM Poor Bed". A similar change may be accomplished for the AM Poor Bed as it becomes more concentrated in antimicrobial agent.

Specific antimicrobial agents that may be adjusted in concentration from aqueous media include but are not limited to those described below.

Examples of the types of microbiocidal compounds which may be employed in this invention include, but are not limited to, phenoxarsines (including bisphenoxarsines), phenarsazines (including bisphenarsazines), maleimides, isoindole dicarboximides, having a sulfur atom bonded to the nitrogen atom of the dicarboximide group, halogenated aryl alkanols and isothiazolinone compounds. Organotin compounds are also specifically contemplated.

The microbiocidal phenoxarsine and phenarazine compounds useful in the compositions of this invention include compounds represented by the formulas:

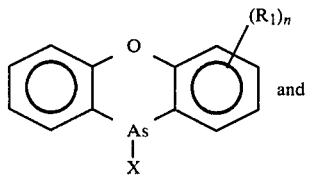

and

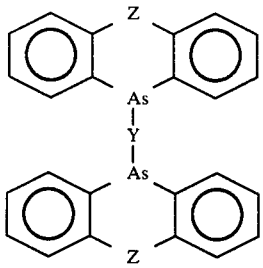

Where x is halogen or thiocyanate, y is oxygen or sulfur, z is oxygen or nitrogen, R is halo or lower alkyl, and n is 0 to 3.

Examples of these phenoxarsines and phenarsazines include, but are not limited to, 10-chlorophenoxarsine; 10-iodophenoxarsine; 10-bromophenoxarsine; 4-methyl-10-chlorophenoxarsine; 2-tert-butyl-10-chlorophenoxarsine; 2-methyl-8, 10-dichlorophenoxarsine; 1, 3, 10-trichlorophenoxarsine; 2, 6, 10-trichlorophenoxarsine; 1, 2, 4, 10-tetrachlorophenoxarsine; 10,10'-oxybisphenoxarsine (OBPA); 10-thiocyanato phenoxarsine; and 10,10'-thiobisphenoxarsine; 10,10'-oxybisphenarsazine and 10,10'-thiobisphenarsazine.

The microbiocidal maleimide compounds useful in the compositions of this invention are exemplified by a preferred maleimide, N-(2-methylnaphthyl) maleimide.

The microbiocidal compounds useful in the practice of this invention which are isoindole dicarboximides having a sulfur atom bonded to the nitrogen atom of the dicarboximide group are compounds which contain at least one group having the structure:

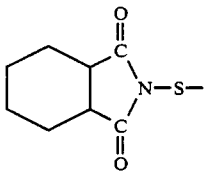

The preferred isoindole discarboximides are the following:

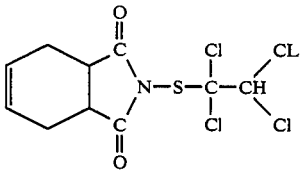

bis-N[(1, 1, 2, 2-tetrachloroethyl)thio]-4-cyclohexene-1, 2-dicarboximide,

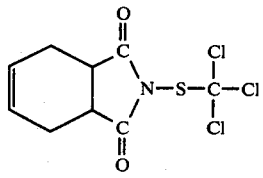

n-trichloromethylthio-4-cyclohexene-1, 2-dicarboximide,

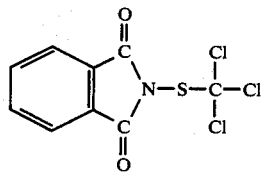

N-trichloromethylthio phthalimide.

The halogenated aryl alkanols which can be used as microbiocidal compounds in accordance with this invention are exemplified by a preferred compound, 2, 4-dichlorobenzyl alcohol.

An example of a preferred isothiazolinone compound useful in the composition of this invention is 2-(n-octyl-4-isothiazolin-3-one).

The most preferred microbiocidal compounds are the bisphenoxarsines and bisphenarsazines having the formula:

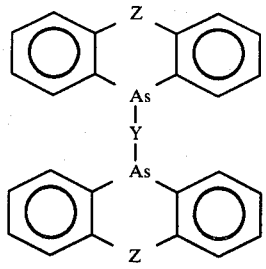

where Y is oxygen or sulfur and Z is oxygen or nitrogen. Of these bisphenoxarsines and bisphenarsazines, the most preferred are 10, 10′-oxybisphenoxarsine; 10, 10′-thiobisphenoxarsine; 10, 10′-oxybisphenarsazine; and 10, 10′-thiobisphenarsazine.

It is also within the scope of the invention to include other typical known antimicrobial agents such as bis(tri-n-butyl tin) oxide (TBTO) and the like.

Suitable media include those which are capable of dissolving or dispersing the antimicrobial agent. Obviously the selection of such medium is dependent on the nature of the agent such property would be readily determined by one skilled in the art. It is preferred that the medium be an aqueous liquid. It is also understood that various non aqueous constituents such as surfactants, leveling agents, buffers, dyes, organic solvents, etc. may be included in the media provided that such additional constituents do not interfere with the operation of the process.

The polyamides useful in this invention are conventional polymeric materials containing the amide linkage

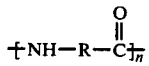

and typified by solid polyamide polymers known generically as nylon. Included in the list of useful polyamides are those nylons designated as nylon 6, nylon 66, nylon 7, nylon 11 and others.

The polyamide material may be in any suitable solid form to facilitate efficient contact with the aqueous media containing the antimicrobial agent to be removed. Suitable solid forms may include granules, pellets, free-standing films, coatings on suitable substrates, foams and fibers. Due to a favorable surface-to-volume ratio, fibers, or yarns and fabrics produced from polyamide fibers are preferred. However, the pellet form is also preferred due to ease of handling and other engineering consideration.

The invention may be practiced by simply contacting the antimicrobial agent containing aqueous media with a bed of polyamide material for sufficient time to allow all or a proportion of the agent to be absorbed by the polyamide absorbant. This contact method may be by either batch or continuous processes. The efficiency of removal is governed by the proportion of antimicrobial agent present, relative to the quantity of polyamide material employed and the amount of aqueous media to be treated. The rate of removal is determined by factors that affect the attainment of equilibrium partitioning of the antimicrobial agent between the polyamide and aqueous phases. These factors include contact time, face velocity, temperatures, pH and surface area to volume ratio of the polymeric absorbant.

As an example of a batch technique for adjusting the antimicrobial agent concentration of aqueous media, one may periodically dip a porous holding container filled with polyamide material containing the agent in a concentration different than that of the media. On the other hand, one could also continuously transfer and return the media from a treatment vessel, such as for example a beck dye bath, to another vessel containing a bed of the antimicrobial agent containing polyamide material. This procedure is illustrated in FIG. 1.

Other treatment vessels include conventional equipment utilized in dyeing of fibers. These are convenient vessels in which to hold the medium used for treatment of the fibers. For example, vats, stock dyeing, skein dyeing, rope dyers, continuous dye ranges, Kuesters or Becks would be suitable.

A suitable apparatus system to conduct the process of the invention is illustrated in FIG. 1 in the form of a schematic diagram. Fiber 11 is passed through aqueous media 12 which is contained in treatment vessel 13. Roller 20 is used to guide fiber 11 during its passage through vessel 13. The fiber is treated by the media to alter its antimicrobial agent content. The media may be passed intermittently or continuously into bed holding vessels 14 and 15 and then returned to vessel 13 through transfer pipes 16, 17, 18, and 19. Such passage is effected through use of pumps 21 and 22. Beds 23 and 24 are contained in vessels 14 and 15 and consist of polyamide materials which desirably have an antimicrobial agent concentration higher and lower, respectively, than that of the media to be circulated through the beds. This would permit one to have the ability to raise or lower the concentration of the agent in the media wherever desired. Following treatment in treatment vessel 13, fiber 11 may be passed through water rinse tank 25. The water from tank 25 may then be cleansed of carryover antimicrobial agent by connection with the treatment system by lines 26 and 27. Pumps 28 and 29 provide circulation for this portion of the system.

The following Examples serve to further illustrate the practice of the invention.

EXAMPLE I

Preparation of simulated beck dye bath 0.5 mL TRITON X-100 was added to 500 mL tap water. No pH adjustment was made. The pH was 6.8.

Treatment

The fiber and pellet weights and bath volumes used are shown in Table 1.

The simulated beck dye bath was heated to boiling in beakers covered with watch glasses. Untreated nylon fiber (yarn) samples were added to the bath simultaneously with nylon pellets containing 4.5% OBPA by HPLC suspended in nylon net bags. The solution containing both the fiber and pellets were heated together at 95° to 100° C. for 30 minutes. The samples were removed, squeezed, and rinsed in two 500 mL portions of deionized water at room temperature. The samples were squeezed and air dried.

EXAMPLE II

Simulated beck dye bath 1.0 mL Triton X-100 was added to 1 L tap water. No pH adjustment was made. The pH was 6.8.

Treatment—Timed Uptake

Fiber and pellet weights, bath volumes, and treatment times are shown in Table 1. Each fiber sample and pellet bag pair was added to individual beakers of boiling dye bath. At the appropriate time intervals the fiber and pellets were removed and rinsed in 1 1 L portions of deionized water and dried in a 45° oven overnight. 2 mL dye bath aliquots were removed, after fiber treatment, for arsenic analysis by SDDC.

Figure 2:
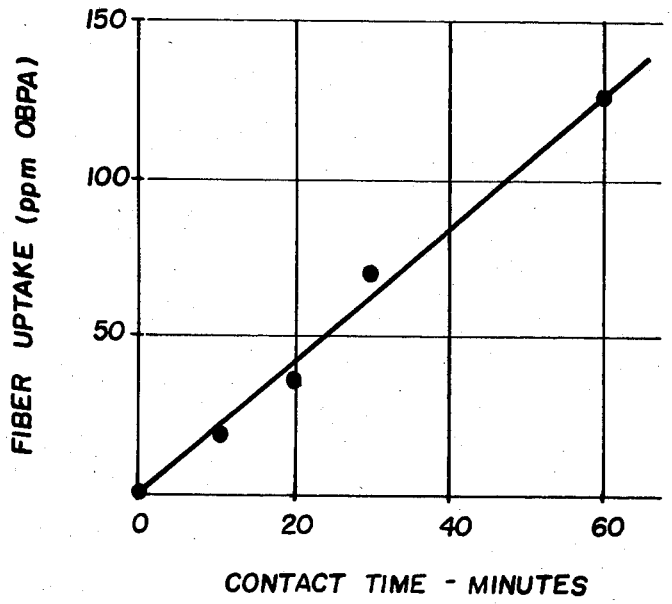
FIG. 2 is a plot illustrating OBPA uptake into a fiber and into an aqueous media as a function of contact time.
Figure 3:
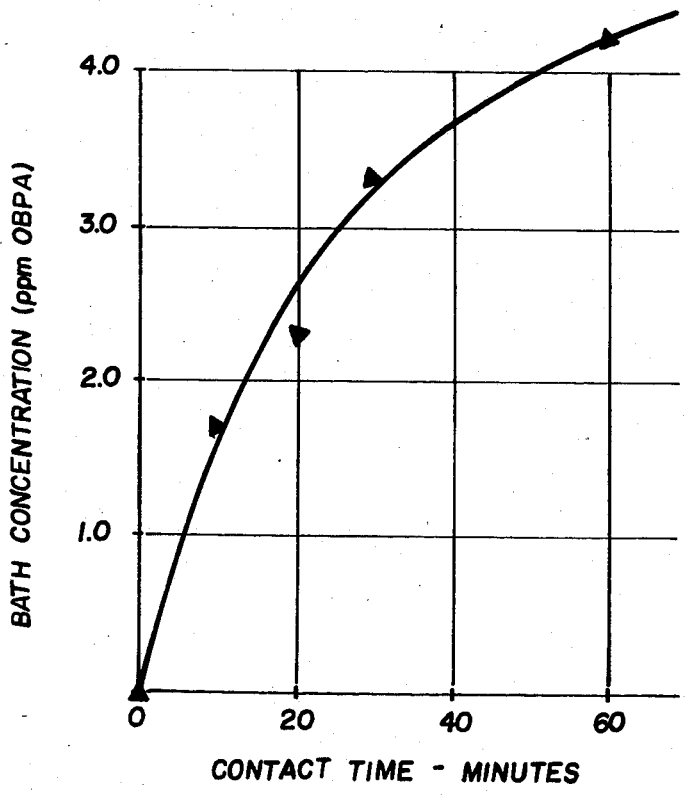
FIG. 3 is a plot of bath concentrations as a function of contact time.

Analyses of Treated Fibers 1-g samples of the treated fibers were soxhlet extracted overnight with methanol and analyzed for arsenic. The results are tabulated in Table 1. The results of the timed uptake experiment are shown graphically in FIGS. 2 and 3.

TABLE 1

BATH TREATMENT OF NYLON FIBERS USING NYLON PELLETS CONTAINING OBPA

| SAMPLE # | NYLON PELLETS WEIGHT GRAMS 4.5% OBPA | BATH Vol. mL | NYLON FIBER WEIGHT GRAMS | TIME IN BATH MINUTES | OBPA FINAL BATH CONC. ppm | FIBER CONCENTRATION METHANOL EXTRACT, OBPA ppm | STAPH. ZONE SIZE mm |
|---|---|---|---|---|---|---|---|
| 1 | 0.1384 | 160 | 8.0535 | 10 | 1.7 | 18 | 2 |
| 2 | 0.1459 | 164 | 8.2022 | 20 | 2.4 | 36 | 4 |
| 3 | 0.1432 | 165 | 8.2582 | 30 | 3.3 | 70 | 6 |
| 4 | 0.1463 | 160 | 8.0908 | 60 | 4.2 | 125 | 7 |
| CONTROL | 0 | 80 | 4.3 | 10 | N.D. | N.D. | 0 |

I claim:

1. A method of adjusting antimicrobial agent concentration of an aqueous media, comprising:

obtaining a first stream of antimicrobial agent containing aqueous media from an antimicrobial treatment vessel;

passing said first stream through and in contact with a bed of solid polyamide absorbant material, said polyamide absorbant material containing a concentration of the same antimicrobial agent that is different from that in said first stream whereby the antimicrobial agent concentration in said stream is adjusted, said antimicrobial agent having a partition coefficient, defined as the ratio of antimicrobial agent absorbed by the polyamide absorbant relative to that retained in the aqueous media at equilibrium, of at least about 10:1 to either increase or decrease the antimicrobial concentration in said stream; and then returning said adjusted stream to said antimicrobial treatment vessel.

2. The method of claim 1 wherein:

said antimicrobial agent is present in said bed of polyamide material in a concentration greater than that of said first stream whereby the antimicrobial agent concentration of said returned stream is higher than that of the first stream.

3. The method of claim 1, wherein:

said antimicrobial agent is present in said bed of polyamide material in a concentration less than that of said first stream whereby the antimicrobial agent concentration of the returned stream is lower than that of the first stream.

4. The method of claim 1, wherein:

said polyamide material comprises nylon.

5. The method of claim 4, wherein:

said antimicrobial agent comprises 10,10'-oxybisphenoxarsine.

6. The method of claim 5, wherein:

said nylon is in the form of a member selected from the group consisting of a fiber, a granule, a film, a foam, a coated article, and a pellet.

7. The method of claim 6, wherein:

said nylon is in the form of a pellet.

8. The method of claim 1, wherein:

said antimicrobial agent comprises 10,10'-oxybisphenoxarsine.

9. A system for adjusting antimicrobial agent concentration of an aqueous medium, comprising:

a vessel for treating a fiber with an aqueous medium containing an antimicrobial agent, having a partition coefficient, defined as the ratio of antimicrobial agent absorbed by the polyamide absorbant relative to that retained in the aqueous media at equilibrium, of at least about 10:1 to either increase or decrease the antimicrobial concentration in said aqueous medium transfer means for passing and returning said medium from said treatment vessel to a second vessel which contains a bed of polyamide absorbant material which contains the same antimicrobial agent as said aqueous medium, and transfer means for passing and returning said medium from said treatment vessel to a third vessel contains a bed of polyamide absorbant material which contains the same antimicrobial agent as said aqueous medium at a concentration less than said second vessel.

* * * * *